US007083455B1

(12) United States Patent
Miura et al.

(10) Patent No.: US 7,083,455 B1
(45) Date of Patent: Aug. 1, 2006

(54) FPC CONNECTOR

(75) Inventors: Kazuto Miura, Kanagawa (JP); Hiroshi Yamane, Kanagawa (JP); Yoshiyuki Nakai, Kanagawa (JP); Kenichi Toda, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/322,286

(22) Filed: Jan. 3, 2006

(30) Foreign Application Priority Data

Jan. 17, 2005 (JP) ..... 2005-009608

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 6,089,905 A * 7/2000 Shimmyo et al. ..... 439/495
6,669,503 B1 * 12/2003 Hirose ..... 439/495

FOREIGN PATENT DOCUMENTS

JP 06-026179 U 4/1994
JP 06-088078 U 12/1994
JP 2001-035576 A 2/2001
JP 2004-192967 A 7/2004

* cited by examiner

*Primary Examiner*—Tho D. Ta

(74) *Attorney, Agent, or Firm*—Rader, Fishman & Grauer PLLC

(57) ABSTRACT

An FPC connector comprises: a housing in which is formed a concave portion into which an FPC with a pair of engaging convex portions arranged on two flanks of a terminal portion of the FPC, is inserted; a cover-housing for covering, with opening and closing enabled, the concave portion of the housing, the housing having a pair of protrusions that protrude from a bottom face of the concave portion and are latched by the pair of engaging convex portions; and a pair of metal reinforcing plates, adjoining two flanks of the pair of protrusions, the metal reinforcing plates having convex portions that are latched by the protrusions and the engaging convex portions.

2 Claims, 6 Drawing Sheets

FPC CONNECTOR

This application is based on and claims the benefit of priority from Japanese Patent Application No. 2005-009608, filed on Jan. 17, 2005, the content of which is incorporated herein by reference.

BACKGROUND OF THE INVENTION

1. Field of the Invention

The present invention relates to connectors for flexible flat cables-printed circuits that possess flexibility, referred to as FPCs (Flexible Printed Circuits), FFCs (Flexible Flat Cables), and the like. In this specification, a flexible flat cable is generically referred to as an FPC. The present invention relates, in particular, to a connecting structure for an FPC connector and an FPC terminal.

2. Related Art

In electronic devices in recent years, flexible flat cables (FPCs) are used for connecting printed circuit boards and electronic component modules mounted in portable information devices typified by, for example, DVCs (Digital Video Cameras), DSCs (Digital Still Cameras), cell-phones, and PDAs (Personal Digital Assistants).

An FPC connector that is surface-mounted on a printed circuit board —what is called a surface-mounted FPC connector—is provided with: an insulating housing, on which an insertion area, into which an FPC is inserted, is formed, and a plurality of contacts mounted in parallel at a prescribed pitch on the housing. In order to make the FPC and the contacts touch, for example, a cover-housing that opens and closes is provided at the insertion area.

In raising the mounting density of FPC connectors that are surface-mounted on a printed circuit board, lowering of mounting height (lowering of profile) and reduction of mounting area are required, and progress is being made with multi-pin and narrow pitch contacts arrayed on these surface-mounted FPC connectors.

For this type of surface-mounted FPC connector, FPC connectors are being invented in which the mounting area on the printed circuit board is small, disconnection of a pair of FPCs from the FPC connector does not easily occur, and moreover, alignment with contacts is easy (for example, see Patent Document 1).

The FPC connector according to Patent Document 1 is formed of a socket-housing, an open-close cover-housing, and a plurality of contacts, and has a terminal socket into which terminals of the FPC pair are inserted. A first and a second FPC have, respectively, a first and a second flat terminal. The first flat terminal and the second flat terminal are disposed in parallel in the terminal socket, as a pair on the same plane, and the first FPC and the second FPC are connected to the FPC connector.

Moreover, first and second rectangular shaped protrusions are formed on the first and the second flat terminals. In a state in which the first and the second rectangular shaped protrusions are facing one another, when the first and the second flat terminals are inserted via the terminal socket into the socket-housing, the first and the second rectangular shaped protrusions make contact with a central protrusion provided in the socket-housing and are positioned with respect to insertion direction. When the cover-housing is closed, a disconnection-prevention protrusion provided in the cover-housing makes contact with the first and the second rectangular shaped protrusions, so that each of the first and the second FPCs does not easily disconnect from the FPC connector.

The pair of FPCs according to Patent Document 1 includes the first and the second rectangular shaped protrusions that can be disposed in a state in which they face one another; moreover, in the FPC connector according to Patent Document 1, the central protrusion for positioning the first and the second rectangular shaped protrusions, and a disconnection-prevention protrusion to prevent the pair of FPCs from detaching in a direction opposite to that of insertion, are provided. Accordingly, compared to cases in which two FPC connectors are disposed in parallel, with one FPC connector a central barrier is not necessary, and the mounting area of the FPC connector can be made small.

Furthermore, in a state with the cover-housing closed, the disconnection-prevention protrusion fits under a notch formed in the terminal socket, and by positioning the disconnection-prevention protrusion behind the first rectangular shaped protrusion or the second rectangular shaped protrusion, and the first rectangular shaped protrusion or the second rectangular shaped protrusion making contact with the disconnection-prevention protrusion, even if a force tending to disconnect the FPCs from the socket-housing acts on the first FPC or the second FPC, disconnection does not easily occur.

Furthermore, reverse insertion into a connector for multipolar flat wires (referred to as FPC, below), can be assuredly prevented, and displacement between the terminal flat conductor and the contacts inside the connector does not occur, so that an FPC connector in which a stable connection can be assured is designed (for example, see Patent Document 2).

In the FPC connector according to Patent Document 2, a key groove open to the front end, asymmetrically positioned in a lateral direction, is formed on the terminal of the FPC, engaging concave portions are formed on left and right side ends of the terminal, and inside the connector connected to this FPC, contacts connected to conductive patterns on the terminal, and engaging protrusions for engaging a positioning upright wall for fitting the key groove and the engaging concave portions, are each provided.

Patent Document 1: Japanese Patent Application, Laid Open No. 2004-192967.

Patent Document 2: Japanese Utility Model Application, Laid Open No. Hei6-26179.

FIG. 8 is a plan view showing a configuration of FPCs and an FPC connector therefor, according to Patent Document 1. FIG. 8 of the present application corresponds to FIG. 1 of Patent Document 1. In FIG. 8, a first FPC 61 has a flat terminal 611, and a second FPC 62 has a second flat terminal 612.

Conductive patterns 613 and 614 formed of copper foil are exposed, respectively, on the back side of the flat terminals 611 and 612. The FPCs 61 and 62 each have four conductive wires (core wires). Furthermore, a first rectangular shaped protrusion 615 is formed on the right side of the first flat terminal 611, and a second rectangular shaped protrusion 616 is formed on the left side of the second flat terminal 612.

In FIG. 8, in cases in which the first conductive pattern 613 and the second conductive pattern 614 are each disposed on the back sides, the rectangular shaped protrusion 615 and the rectangular shaped protrusion 616 are disposed facing each other in the flat terminals 611 and 612.

In FIG. 8, an FPC connector 70 is composed of an insulating socket-housing 73 and an insulating cover-housing 74, with a plurality of C-shaped spring-contacts 75. A terminal socket 710, into which the flat terminals 611 and 612 are inserted, is formed in the socket-housing 73. Additionally, the plurality of C-shaped spring-contacts 75 is disposed in the socket-housing 73 so as to face the terminal socket 710.

The cover-housing 74 is rotatably coupled to the socket-housing 73 so as to open and close the terminal socket 710. In a state with the terminal socket 710 closed, the cover-housing 74 applies pressure to the plurality of C-shaped spring-contacts 75, to make them connect with the flat terminals 611 and 612 that are inserted into the terminal socket 710.

In a state with the cover-housing 74 of FIG. 8 opened, a central protrusion 730 is formed on the lower side of the terminal socket 710. On the bottom side of the terminal socket 710, a pair of upright walls 761 and 762 is formed so as to face the two flanks. At the front portion of the bottom face of the terminal socket 710, a notch 733 is formed, under which a protrusion 740, for preventing disconnection with respect to the cover-housing 74, is fitted.

In FIG. 8, the flat terminal 611 of the first FPC 61 is guided by a first side wall 731 of the central protrusion 730 and the upright wall 761, and is inserted into a first terminal socket 71*a*. Similarly, the flat terminal 612 of the second FPC 62 is guided by a second side wall 732 of the central protrusion 730 and the upright wall 762, and is inserted into a second terminal socket 71*b*.

If the flat terminals 611 and 612 each advance a certain distance, the rectangular shaped protrusions 615 and 616 formed on the FPCs 61 and 62 make contact with the central protrusion 730, and the advance is halted. Next, when the cover-housing 74 is closed, the C-shaped spring-contacts 75 sandwich the flat terminals 611 and 612. Furthermore, when the cover-housing 74 is closed, the disconnection-prevention protrusion 740 fits under the notch 733.

In FIG. 8, if a force acts to separate the FPCs 61 and 62 from the connector 70, the rear edges of the rectangular shaped protrusions 615 and 616 each make contact with the disconnection-prevention protrusion 740, and the FPCs 61 and 62 are prevented from separating from the connector 70.

The FPCs shown in FIG. 8 are single-sided FPCs with a conductive pattern on one side only. Generally, copper foil is laminated on a base (also referred to as a base film) formed of polyimide or the like, and the copper foil is etched to form a conductive pattern. The conductive pattern is then coated with coverlay (also referred to as overlay) thin film, formed of polyimide or the like. In the terminal of a single-sided FPC connected to the connector, since the conductive pattern is exposed and a certain level of strength (rigidity) is required, a reinforcing plate formed of polyester or polyimide is affixed to the base.

On the other hand, in double-sided FPCs with conductive patterns on both sides of the base (insulating substrate), the terminal connected to the connector does not have a reinforcing plate. Additionally, in recent years, even for the single-sided FPC, in order to lower the profile of the connector, there is a tendency not to provide the reinforcing plate. For example, the profile of the mounting of the FPC connector is lowered to about 1 mm, and for the FPC connected to a connector with this type of low profile, the thickness of the terminal is decreased from 0.3 mm to about 0.15 mm.

With the FPCs shown in FIG. 8, very little force is required in inserting and disconnecting the FPCs, and it is what is called a ZIP (Zero Insertion Force) connector. In an FPC compatible with this ZIP-type FPC connector, in many cases, as in an FPC 81 described below in Patent Document 2, a pair of engaging convex portions is arranged on the two flanks of the connecting terminal, in order to prevent disconnection from the connector.

As described above, the FPCs with the pair of engaging convex portions arranged on the two flanks of the connecting terminals, for example, are latched by a pair of protrusions forming a pair of upright walls 761 and 762 (see FIG. 8), and the FPCs are prevented from disconnecting from the connector.

Furthermore, in the ZIF connector for the FPCs, in order to minimize the mounting area, there is a tendency to make the abovementioned pair of protrusions very small. Since this pair of protrusions is integrally formed with the housing from synthetic resin, when force tending to separate the FPCs from the connector acts, in a connector whose size has been minimized, the abovementioned pair of protrusions is easily broken by shearing force of the pair of engaging protrusions arranged in the FPCs.

In an FPC that is multi-polar with about 80 poles and has a narrow pitch of about 0.4 mm, with a thin film as described above, in order to prevent disconnection from the connector, for a connector compatible with an FPC in which a pair of engaging convex portions is provided, on the two flanks of a connecting terminal, a reinforced structure is required for a pair of protrusions that is latched by the abovementioned pair of engaging convex portions. This topic may be considered the object of the present invention.

FIG. 9 is a plan view of a partial transverse cross-section when the FPC and the connector, according to Patent Document 2, are connected. FIG. 9 of the present application corresponds to FIG. 3 of Patent Document 2. In FIG. 9, the FPC 81 is configured so that a plurality of conductive patterns 83 is disposed in parallel and separated, between upper and lower film 82 bands, the terminal of the single-sided film 82 is peeled for a prescribed length only, and the conductive patterns 83 are exposed, this being the connecting terminal 84.

Moreover, in the connecting terminal 84, a key groove 85 of approximately the same width as the conductive patterns 83, is formed in an asymmetric position in the width direction, opening to the front end 86. On the left and right side edges 87 of the longitudinal direction of the connecting terminal 84, in order to prevent disconnection from the connector, an engaging concave portion 88, a convex portion 89, and an insertion notch 810 are arranged, sequentially from the rear of the connecting terminal 84 towards the front edge 86.

Furthermore, corners of the insertion notch 810 and the front end 86 are cut to facilitate insertion of the connector. Additionally, an elongated hole 812 is provided near the convex area 89 in the connecting terminal 84, and elastic deformation is possible in inward and outward directions (in the direction of the width of the terminal 84) of the convex area 89.

Moreover, in FIG. 9, a slit 94, into which the connecting terminal 84 is inserted, is formed in the connector 93, into which the FPC 81 is inserted and is connected to. In the slit 94, a plurality of contacts 95, each separately electrically connected to the conductive patterns 83 of the connecting terminal 84, is housed in parallel. The contacts 95 are "swing-flex" type that sandwich and press-contact the connecting terminal 84.

Furthermore, inside the slit 94, a positioning upright wall portion 96 for fitting the key groove 85 is built at a position to accommodate the key groove 85. On the inner left and right side walls of the slit 94, an engaging protrusion 97 shaped so as to fit the engaging concave portion 88 is arranged jutting out.

In FIG. 9, when the FPC 81 is inserted into the slit 94 of the connector 93, the key groove 85 of the connecting terminal 84 fits the positioning upright wall 96 and is positioned, and the convex portion 89 of the connecting terminal 84 makes contact with the engaging protrusion 97 of the connector 93.

In addition, when the FPC 81 is inserted into the slit 94, the convex portion 89 elastically deforms in an inward direction with respect to the elongated hole 812 area, and after getting over the engaging protrusion 97, is restored, and the engaging concave portion 88 engages with the engaging protrusion 97 to prevent disconnection. At the same time, the plurality of conductive patterns 83 is electrically connected to the contacts 95. When the FPC 81 is removed, in the same way as for insertion, the convex portion 89 elastically deforms, so that easy removal from the connector 93 is possible.

The FPC connector shown in FIG. 9 is what is called a NON-ZIF connector. A low profile is possible with this type of NON-ZIF FPC connector; however, as described above, in a thin-film FPC that is multi-polar with about 80 poles, there is resistance to the plurality of contacts, and it is difficult to insert the FPC into the connector.

That is, although the connecting structure of the connector to the FPC shown in FIG. 9, having few poles, is effective with thick-film FPCs that have a reinforcing plate provided, application to a connecting structure for a connector to multi-polar, thin-film FPCs, which is an object of the present invention, is difficult. The addition of a slider to the terminal of an FPC and a mechanism for connecting this slider to the NON-ZIF FPC connectors has been invented; however, the slide thickness alone raises the mounting height of the connector, and this is not suited to the small and thin types of portable electronic devices of recent years. A new FPC connector that is suitable for ZIF FPC connectors and low profile connectors is required.

SUMMARY OF THE INVENTION

In light of these types of problems, the present invention has as an object the provision of a ZIF FPC connector with multi-pin contacts, narrow pitch, and a low profile, the FPC connector having a structure such that connection can be assured for an FPC that has a pair of engaging convex portions on the two flanks of the terminal for preventing disconnection from the connector.

To realize the abovementioned object, the present invention includes a new FPC connector, of a type described below, having a structure in which a pair of protrusions that latches a pair of engaging convex portions arranged on an FPC are provided on a housing, the pair of protrusions being reinforced by a metal reinforcing plate.

In a first aspect of the invention, the FPC connector includes a housing, of approximately rectangular solid shape, in which is formed a concave portion into which an FPC, with a pair of engaging convex portions arranged on the two flanks of a terminal thereof, is inserted, a cover-housing, of approximately oblong board shape, for covering, with opening and closing enabled, the concave portion of the housing, the housing having a pair of protrusions that protrudes from a bottom face of the concave portion and are latched by the pair of engaging convex portions, a pair of metal reinforcing plates, adjoining two flanks of the pair of protrusions, being provided, and the metal reinforcing plates having convex portions that are latched by the protrusions and the engaging convex portions.

According to the first aspect of the invention, the FPC connector is provided with the housing of approximately rectangular solid shape and the cover-housing, of approximately oblong board shape. The concave portion is formed in the housing. The pair of engaging convex portions is arranged on the two flanks of the terminal of the FPC, and the FPC is inserted into the concave portion. Furthermore, the cover-housing covers, with opening and closing enabled, the concave portion of the housing. The housing has the pair of protrusions that protrude from the bottom face of the concave portion and are latched by the pair of engaging convex portions.

In the FPC, copper foil that forms conductive patterns is bonded to a base of film form, made of insulative polyester or polyimide. The conductive patterns are coated with insulative coverlay, but the terminal for connecting with a connector is not coated with the insulative coverlay, and a plurality of conductive patterns is exposed. The conductive patterns of the terminal are conductively in contact with the contacts provided in the FPC connector.

An end-terminal of the FPC connected to the connector is also known as an edge contact or an edge connector. The plurality of conductive patterns forming this connective face may, for example, have a nickel-gold plating. The FPC may be configured so that a plurality of conductive patterns is disposed in parallel and separated, between the base and the coverlay, and the coverlay on the terminal area is peeled for a prescribed length only, to expose the conductive patterns, this being the terminal. The FPC applicable to the present invention may be a single-sided FPC, or may be a double-sided FPC with conductive patterns provided on both sides of a base film.

In the FPC applicable to the present invention, the pair of engaging convex portions is provided on the two flanks of the terminal. In the FPC, the pair of engaging convex portions may protrude in mutually opposing directions orthogonal to the direction in which the connector in inserted, and the pair of engaging convex portions may be strengthened by building up in layers the base, the copper foil, and the coverlay.

A ZIF connector is preferable as the FPC connector according to the present invention. For example, this type of ZIF connector may include an insulating housing in which the concave portion, into which the FPC is inserted, is formed, and a plurality of contacts mounted in parallel at a prescribed pitch on the housing; and in order to make the FPC and these contacts touch, for example, the cover-housing, that opens and closes, is provided at the concave portion. The housing includes the pair of protrusions that protrude from the bottom face of the concave portion, and the pair of engaging convex portions arranged in the FPC is latched by the pair of protrusions.

The FPC connector according to the first aspect of the invention is provided with the pair of metal reinforcing plates adjoining the two flanks of the pair of protrusions, and the metal reinforcing plates have convex portions that are latched by the protrusions and the engaging convex portions.

As described above, in the ZIF connector for the FPC, in order to minimize the mounting area, there is a tendency to make the pair of protrusions very small. Since this pair of protrusions is integrally formed with the housing from synthetic resin, when force tending to separate the FPC from the connector is applied, the abovementioned pair of protrusions, in a connector whose size has been minimized, is easily broken by shearing force of the pair of engaging convex portions arranged in the FPC.

In the FPC connector according to the present invention, breakage of the pair of protrusions is prevented by arranging, next to the two flanks of the pair of protrusions, the pair of metal reinforcing plates that have the convex portions that are latched by the protrusions and the engaging convex portions.

In a second aspect of the FPC connector as described in the first aspect of the present invention, the pair of metal reinforcing plates is pressed into the housing, rotatably supporting an opening-closing axis formed at both ends of the cover-housing, and the bottom faces of the pair of metal reinforcing plates are joined to a printed circuit board.

In the FPC connector according to the second aspect of the invention, the pair of metal reinforcing plates is pressed into the housing and rotatably supports the opening-closing axis formed at both ends of the cover-housing. Furthermore, the bottom faces of the pair of metal reinforcing plates are joined to the printed circuit board.

In general, by soldering the lead area of the plurality of contacts provided in the housing to the front face of the printed circuit board, the connector that is surface-mounted on the printed circuit board, known as a surface-mounted connector, is fixed to the printed circuit board.

Contacts with narrow pitch of about 0.4 mm, for example, have a narrow lead area, and the fixing strength of these contacts to the printed circuit board is not sufficient. According to the present invention, by pressing the pair of metal reinforcing plates into the housing, and additionally by, for example, soldering the metal reinforcing plates to the printed circuit board, insufficient strength in the lead area is compensated for. In addition, the bottom face of the metal reinforcing plates may form the thicker board face.

Furthermore, the pair of metal reinforcing plates according to the present invention rotatably supports the opening-closing axis formed at both ends of the cover-housing. In this way, the pair of metal reinforcing plates has three functional roles: that of protecting the pair of protrusions, that of strengthening the joining of the connector to the printed circuit board, and that of supporting the opening-closing axis of the cover-housing at both ends. This type of FPC connector has a form that is very compact.

According to the FPC connector of the present invention, the pair of engaging convex portions is provided on the two flanks of the FPC terminal, the connector has a pair of protrusions for latching the pair of engaging convex portions, the metal reinforcing plates have convex portions that are latched by the protrusions and the engaging convex portions, and since this pair of protrusions is protected, the FPC does not disconnect from the FPC connector, and the FPC connector and the FPC are assuredly connected.

DETAILED DESCRIPTION OF THE INVENTION

Figure 1:
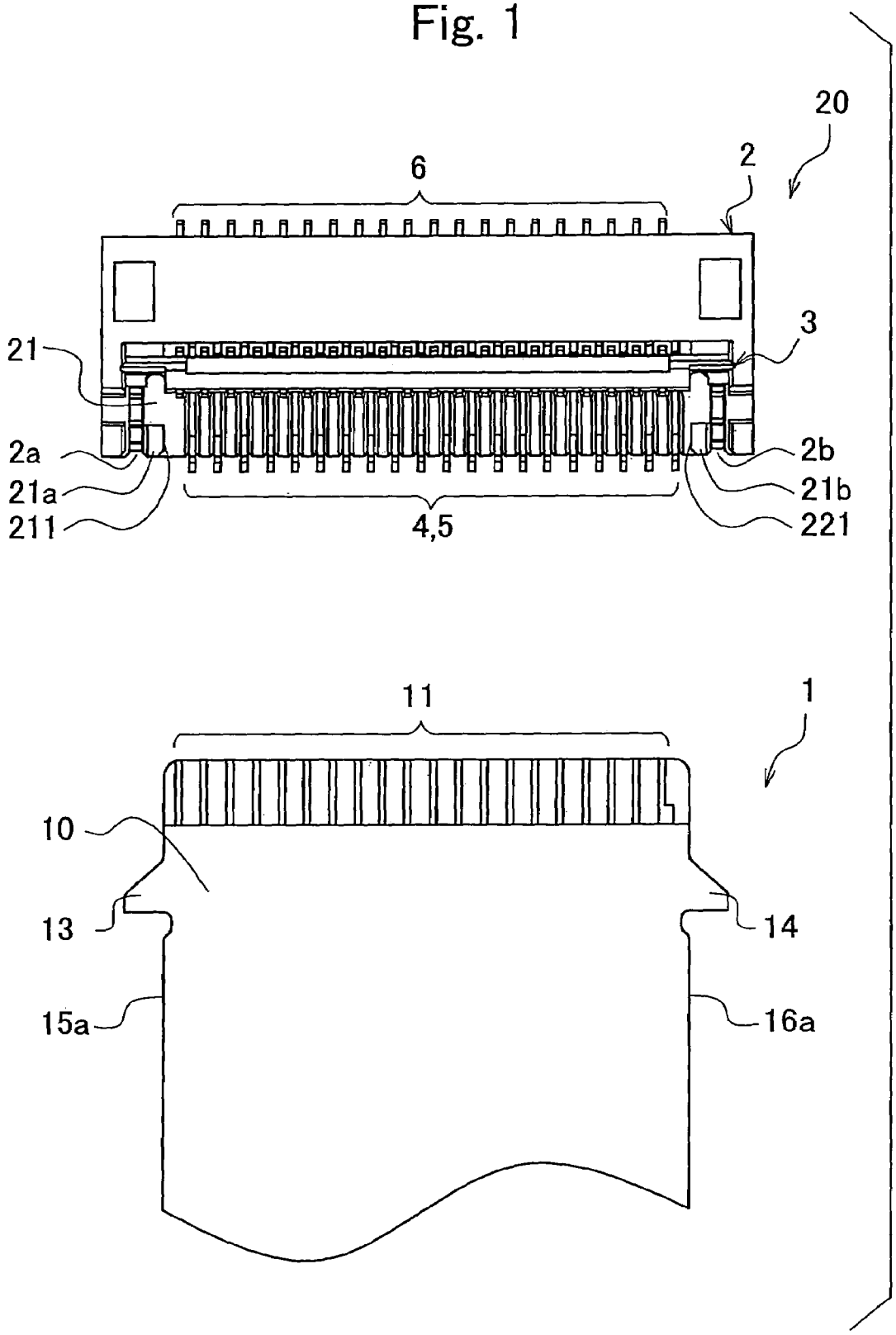
FIG. 1 is a plan layout view of an embodiment of an FPC connector and an embodiment of an FPC that is connected to the FPC connector, according to the present invention.

A best mode for implementing the present invention is explained below, referring to the drawings.

Figure 2A:
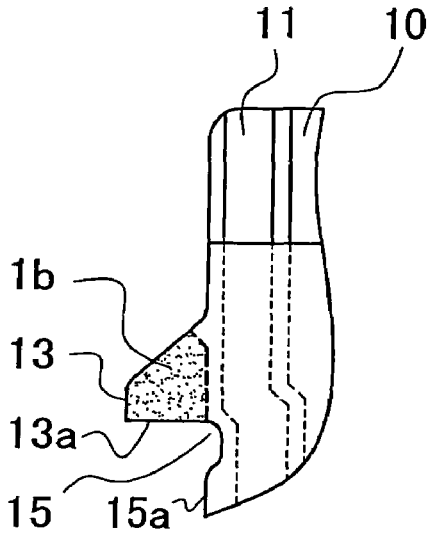
FIGS. 2A and 2B are enlarged views of main parts of the FPC according to the embodiment.
Figure 2B:
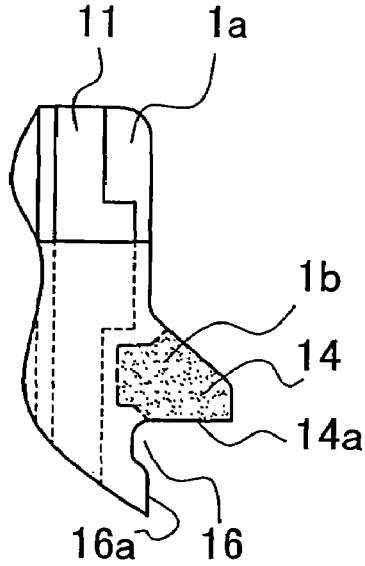
Figure 3:
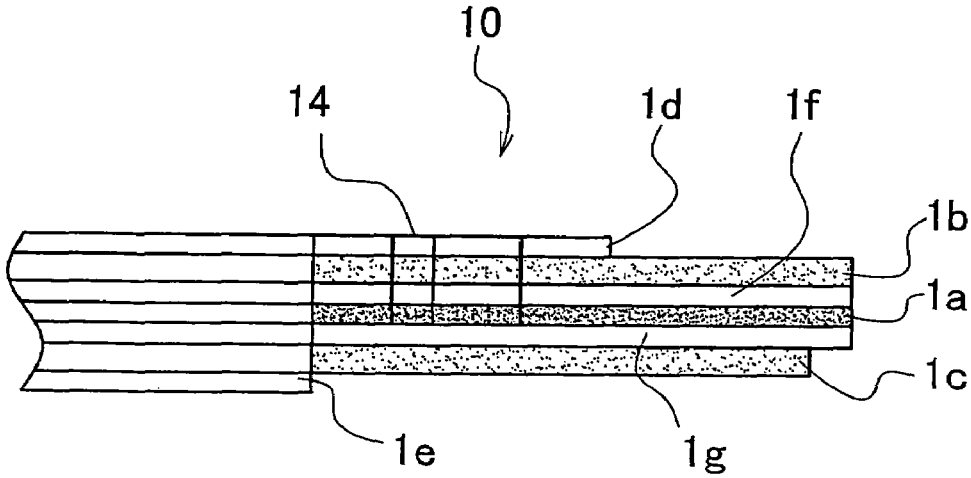
FIG. 3 is a side view of the FPC according to the embodiment.

FIG. 1 is a plan layout view of an embodiment of an FPC connector and an embodiment of an FPC that is connected to the FPC connector, according to the present invention. FIGS. 2A and 2B are enlarged views of main parts of the FPC according to the embodiment. FIG. 2A is an enlarged view including one engaging convex portion, and FIG. 2B is an enlarged view including the other engaging convex portion. FIG. 3 is a side view of the FPC according to the embodiment.

Figure 4:
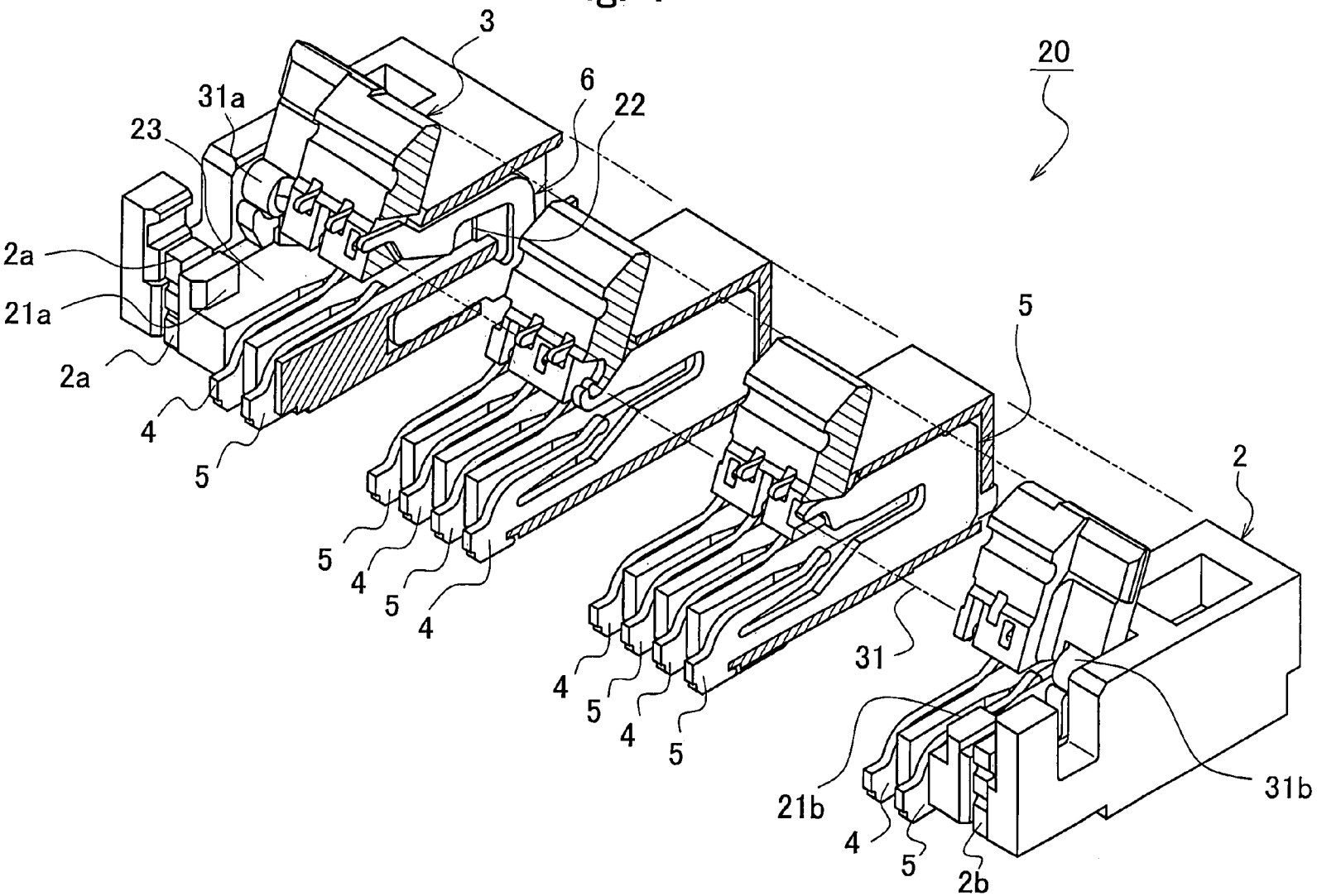
FIG. 4 is a perspective outline view of the FPC connector according to the embodiment, and is a view with a cover-housing in an open state.
Figure 5:
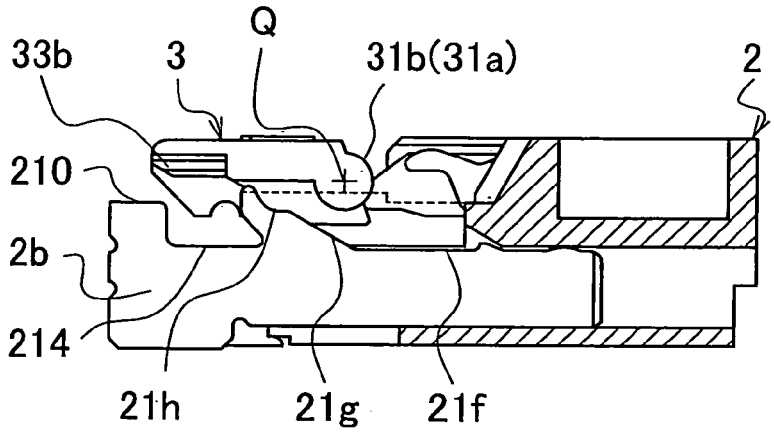
FIG. 5 is a longitudinal sectional side view of a metal reinforcing plate according to the embodiment, and is a view of a state before the cover-housing is assembled in a housing.
Figure 6:
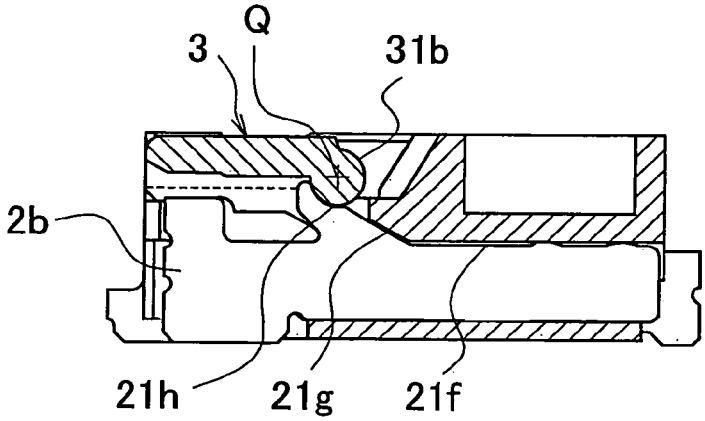
FIG. 6 is a longitudinal sectional side view of the metal reinforcing plate according to the embodiment, and is a view of a state with the cover-housing assembled in the housing.
Figure 7:
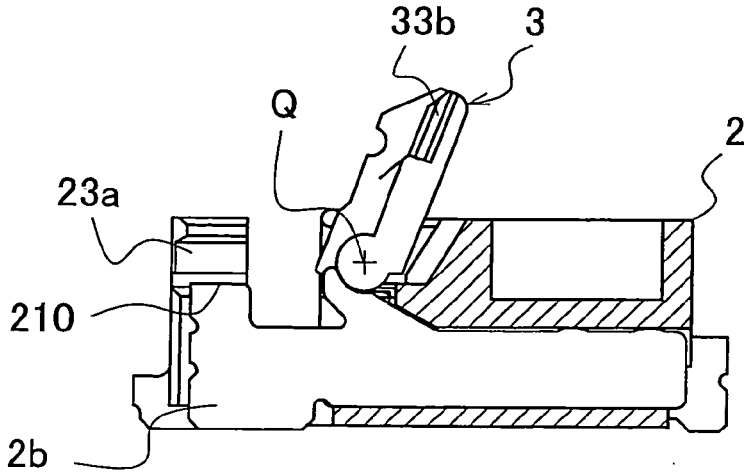
FIG. 7 is a longitudinal sectional side view of the metal reinforcing plate according to the embodiment, and is a view with the cover-housing in an open state.
Figure 8:
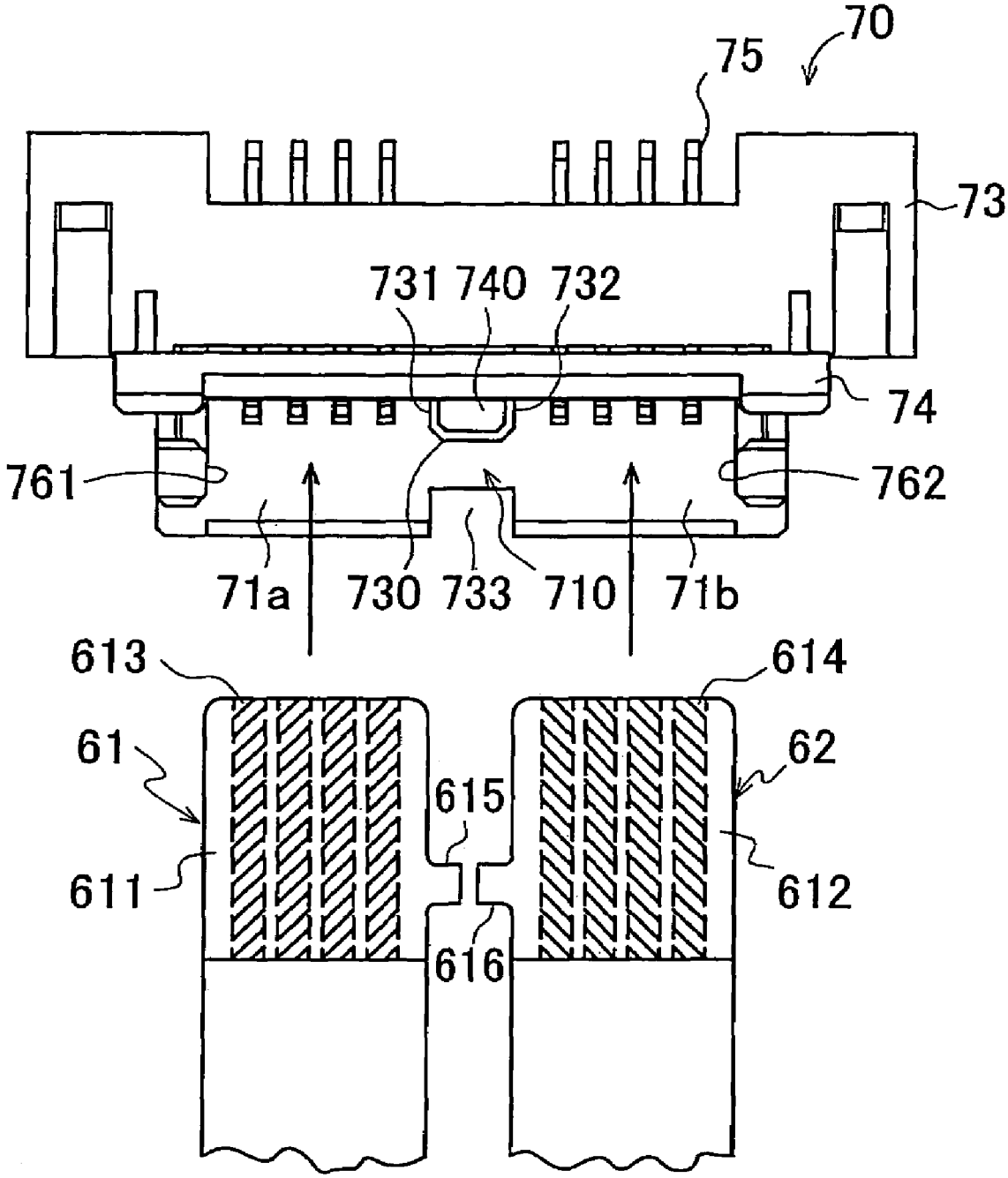
FIG. 8 is a plan view showing a configuration of an FPC and an FPC connector therefor, according to conventional technology.
Figure 9:
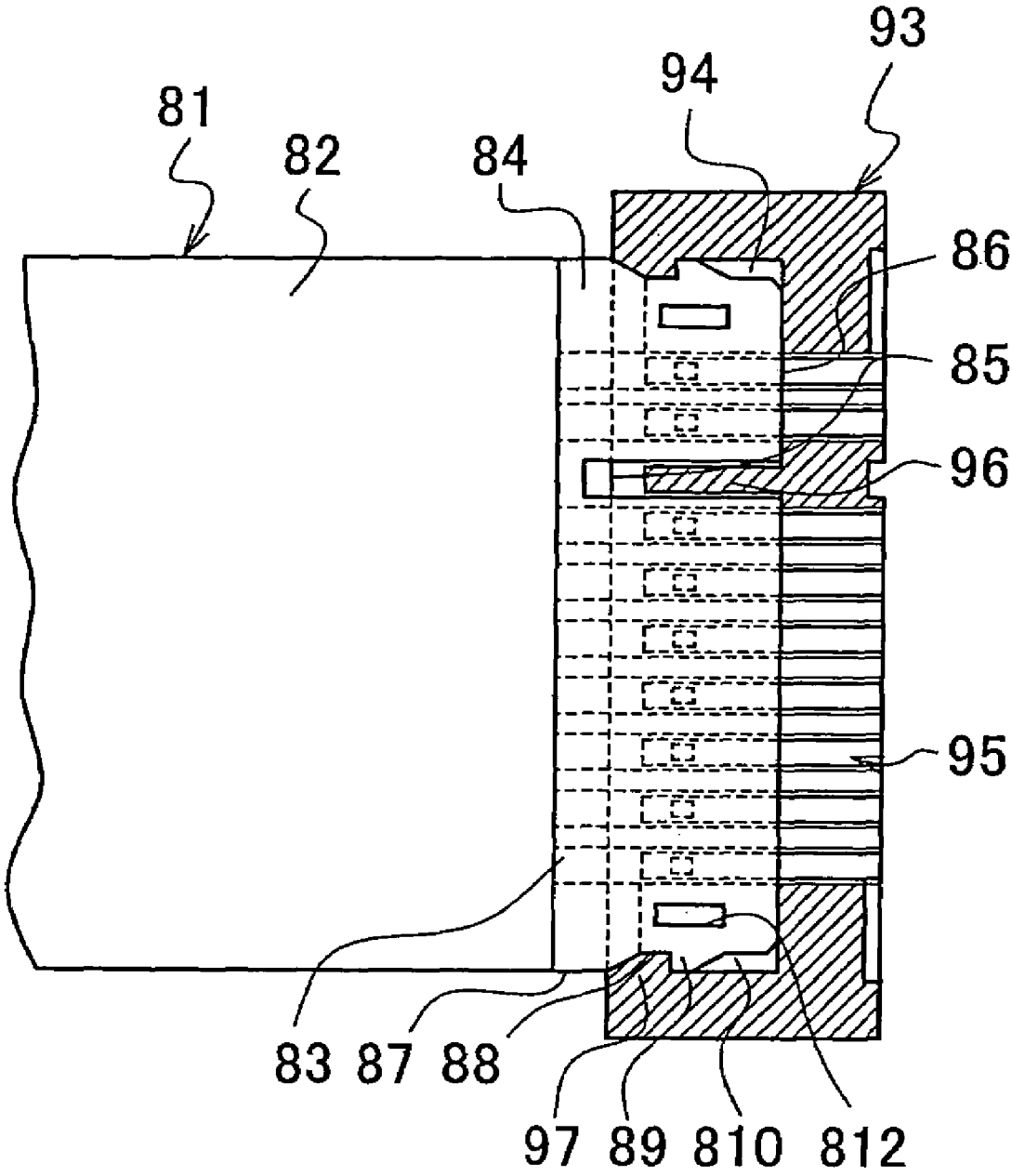
FIG. 9 is a plan view of a partial transverse cross-section when the FPC and the connector, according to the conventional technology, are connected.

FIG. 4 is a perspective outline view of the FPC connector according to the embodiment. FIG. 4 is a view with cover-housing in an open state, and is a sectional view of main parts. FIG. 5 is a longitudinal sectional side view of a metal reinforcing plate according to the embodiment, and is a view of a state before the cover-housing is assembled in a housing. FIG. 6 is a longitudinal sectional side view of the metal reinforcing plate according to the embodiment, and is a view of a state with the cover-housing assembled in the housing. FIG. 7 is a longitudinal sectional side view of the metal reinforcing plate according to the embodiment, with the cover-housing in an open state.

First, a configuration of an FPC applicable to the FPC connector (abbreviated to connector, below) according to the present invention is explained. In FIG. 3, copper foil 1*b* and 1*c* is layered on both sides of a base 1*a*. The base 1*a* is of film form, made of a flexible substrate such as insulating polyester, polyimide, or the like. The copper foil 1*b* and 1*c* is bonded to both sides of the base 1*a* by thermosetting binding material 1*f* and 1*g*. Coverlay 1*d* and 1*e* is formed of a thin film such as polyester, polyimide, or the like.

In FIG. 1, the copper foil 1*b* is etched to form a plurality of conductive patterns 11. The plurality of conductive patterns 11 is coated with the insulating coverlay 1*d*. The copper foil 1*c* is etched to form a plurality of conductive patterns (not shown in the figure). The plurality of conductive patterns is coated with insulating coverlay 1*e*.

The front side of the terminal 10, for making contact with a connector 20, is not coated with the insulating coverlay 1*d*, and the plurality of conductive patterns 11 is exposed (see FIG. 1). In the same way, the rear side of the terminal 10 is not coated with the insulating coverlay 1*e*, and the plurality of conductive patterns is exposed.

The conductive patterns 11 on the front side of the terminal 10 and the conductive patterns on the rear side make electrical contact with the contacts provided in the connector. An end terminal of the FPC 1 connected to the connector is also referred to as an edge connector, and this edge connector may, for example, be given a nickel-gold plating.

In the present embodiment, the FPC 1 is a double-sided FPC. In the terminal 10, the conductive patterns on the rear side are exposed to a longer extent than the conductive patterns 11 on the front side. As shown in FIG. 3, in the terminal 10, coating length of the coverlays 1*d* and 1*e* on the front side is different from the rear side. This is because the contact positions of the contacts provided in the connector are different for the front side and the rear side of the FPC 1.

In FIG. 1 or FIGS. 2A and 2B, the FPC 1 is latched by the connector 20, and a pair of engaging convex portions 13 and 14 that can prevent the FPC 1 from moving in a direction opposite to that of insertion are provided on the terminal 10. In the FPC 1, the engaging convex portions 13 and 14 protrude in mutually opposing directions, orthogonal to the direction in which the connector is inserted. In addition, the pair of engaging convex portions 13 and 14 is formed by building up the base 1*a*, the copper foil 1*b*, and the coverlay 1*d*, in layers (see FIG. 3).

Furthermore, in FIGS. 2A and 2B, the pair of engaging convex portions 13 and 14 include a pair of stopper side edges 13*a* and 14*a* that makes contact with the connector 20 in a direction opposite to the insertion direction of the FPC 1. A pair of notches 15 and 16, formed by narrowing the width between the two side edges of the FPC 1, is provided, in a region extending, in a direction opposite to that in which the FPC 1 is inserted, from corners where the pair of stopper side edges 13*a* and 14*a* are orthogonal to the two side edges 15*a* and 16*a* of the FPC 1. The operation of the pair of notches 15 and 16 is explained below.

Next, the structure of the connector according to the present invention is explained. In FIG. 1 or FIG. 4, the housing 2 of approximately rectangular solid shape and the cover-housing 3 of approximately oblong board shape are provided in the connector 20. A concave portion 21 is formed in the housing. The FPC 1 is inserted into the concave portion 21. Furthermore, the cover-housing 3 covers, with opening and closing enabled, the concave portion 21 of the housing 2. The housing 2 has a pair of protrusions 21*a* and 21*b* that protrudes from the bottom face 23 of the concave portion 21 (see FIG. 4) and are latched by the pair of engaging convex portions 13 and 14.

In FIG. 1 or FIG. 4, a pair of metal reinforcing plates 2*a* and 2*b* that adjoins two flanks of the pair of protrusions 21*a* and 21*b* is provided in the connector 20. The pair of metal reinforcing plates 2*a* and 2*b* has convex portions 210 that are latched by the protrusions 21*a* and 21*b* and the engaging convex portions 13 and 14 (see FIG. 5 or FIG. 7).

The concave portion 21 is open on one side, and on the other side of the concave portion 21 a socket 22 is formed, that the terminal 10 of the FPC 1 makes contact with (see FIG. 4). A plurality of first, second, and third contacts 4, 5, and 6 that is arrayed inside the housing 2 is in electrical contact with the FPC 1 (see FIG. 4).

In FIG. 4, the housing 2 is formed of an insulating synthetic resin made from a nonconductive material. The housing 2 is formed in an approximately rectangular solid shape, and the concave portion 21 is formed in a thin rectangular solid shape into which the FPC 1 is inserted. The FPC 1 is inserted from the open side of the concave portion 21 towards the socket 22.

When the FPC 1 is inserted into the concave portion 21, a pair of upright walls 211 and 221, provided on the opposing pair of protrusions 21*a* and 21*b* (see FIG. 1) formed in the concave portion 21, guides the two side edges 15*a* and 16*a* of the FPC 1 and aligns them with the plurality of first, second, and third contacts 4, 5, and 6. The plurality of first, second, and third contacts 4, 5, and 6 arrayed in the housing 2 is in electrical contact with the FPC 1.

In FIG. 4, the cover-housing 3 of approximately oblong board shape is provided in the connector 20. The cover-housing 3 is formed of an insulating synthetic resin made from a nonconductive material. At one side of the cover-housing 3 an opening-closing axis 31 is rotatably supported at both ends by the housing 2. At the other side of the cover-housing 3, the concave portion 21 opens and closes. By opening the cover-housing 3, the FPC 1 can be inserted into the socket 22.

In FIG. 4, in the cover-housing 3, a pair of cylindrical protrusions 31*a* and 31*b* is disposed coaxially with the opening-closing axis 31 at each flank of the one side of the cover-housing 3. The pair of cylindrical protrusions 31*a* and 31*b* is rotatably supported at both ends by the housing 2. More specifically, the pair of metal reinforcing plates 2*a* and 2*b* that is pressed into the housing 2, rotatably supports the pair of cylindrical protrusions 31*a* and 31*b*.

The cover-housing 3, by closing, presses upon the FPC 1 inserted into the socket 22, and the FPC 1 is made to contact the plurality of first, second, and third contacts 4, 5, and 6. When the cover-housing 3 is closed, a lock mechanism is provided to maintain the closed position of the cover-housing 3.

In FIG. 4, the first contacts 4 and the second contacts 5, disposed alternately in parallel, are arranged inside the housing 2. Furthermore, the third contacts 6, disposed between the neighboring pairs of first contacts 4 and second contacts 5, are provided inside the housing 2.

In FIG. 4, the plurality of first contacts 4 and the plurality of second contacts 5 are in contact with the conductive patterns exposed on the rear side of the FPC 1. The plurality of third contacts 6 is in contact with the conductive patterns 11 exposed on the front side of the FPC 1 (see FIG. 1). The connector 20 is preferably applicable to a double-sided FPC; however, it may also be applied to a single-sided FPC.

In FIG. 1 or FIG. 4, the pair of metal reinforcing plates 2*a* and 2*b* that adjoins two flanks of the pair of protrusions 21*a* and 21*b* is provided in the connector 20. The pair of metal reinforcing plates 2*a* and 2*b* rotatably supports both ends of the opening-closing axis 31. The pair of metal reinforcing plates 2*a* and 2*b* is pressed into the housing 2. The bottom faces of the pair of metal reinforcing plates 2*a* and 2*b* are soldered to a printed circuit board (not shown in the figures). The metal reinforcing plate 2*a* and the metal reinforcing plate 2*b* (see FIG. 7) are similar; however, to facilitate distinguishing location in the connector 20, the metal reinforcing plate 2*a* and the metal reinforcing plate 2*b* are differentiated.

The pair of metal reinforcing plates 2*a* and 2*b* is formed of a metal that can be easily soldered to the printed circuit board, and is formed with a metal plate that is rigid for pressing into the housing. The pair of metal reinforcing plates 2*a* and 2*b* supports the opening-closing axis 31 at both ends, and by being pressed into the housing 2 and joined to the printed circuit board, supplements the joint strength of the connector 20 to the printed circuit board.

Next, a method for assembling the connector according to the present invention is explained, referring to the figures.

First, the plurality of third contacts 6 is installed in the housing 2. As shown in FIG. 4, the plurality of third contacts 6 is pressed into the housing 2 from the side opposite to the concave portion 21 and is fixed in the housing 2. Furthermore, at this stage, the cover-housing 3 is not installed in the housing 2. Next, the plurality of second contacts 5 is installed in the housing 2. As shown in FIG. 4, the plurality of second contacts 5 is pressed into the housing 2 from the concave portion 21 side and is fixed in the housing 2. Furthermore, at this stage also, the cover-housing 3 is not installed in the housing 2.

As shown in FIG. 4, on the upper edge of the metal reinforcing plate 2*b* a low-profile flat surface 21*f* is formed; contiguous with the low-profile flat surface 21*f*, an inclined surface 21*g* is formed; and contiguous with the inclined surface 21*g*, a circular curved surface 21*h* that rotatably supports the cylindrical protrusion 31*b* is formed. In addition, at the extremity of the metal reinforcing plate 2*b* is the convex portion 210 that is latched by the protrusion 21*b* and the engaging convex portion 14. On the other hand, at the extremity of the metal reinforcing plate 2*a* is the convex portion 210 that is latched by the protrusion 21*a* and also the engaging convex portion 13.

On the flat surface 21*f* of the metal reinforcing plates 2*a* and 2*b* having a shape such as this, the pair of conical protrusions 31*a* and 31*b* is disposed so that they face each other, and the pair of metal reinforcing plates 2*a* and 2*b* is temporarily inserted (see FIG. 5). Furthermore, the plurality of first contacts 4 is temporarily inserted into the housing 2. At this stage, as shown in FIG. 5, the cover-housing 3 is separated by a certain distance from the housing 2.

Next, when the pair of metal reinforcing plates 2*a* and 2*b* is inserted (pressed) into the housing 2, the pair of cylindrical protrusions 31*a* and 31*b* makes contact with the housing 2; the pair of cylindrical protrusions 31*a* and 31*b* follows the inclined surface 21*g*, and their axis center Q rises slightly and reaches the circular curved surface 21*h*. At this time, the plurality of first contacts 4 is pressed into the housing 2.

Next, operation of the connector according to the present invention is explained, referring to the figures.

In the connector 20, shown in FIG. 1, in order to minimize the mounting area, there is a tendency to make the pair of protrusions 21*a* and 21*b* very small. Since this pair of protrusions 21*a* and 21*b* is integrally formed with the housing 2 by synthetic resin, when a force tending to cause disconnection from the connector 20 is applied to the FPC 1, in a small sized connector, the pair of protrusions 21*a* and 21*b* tends to break easily, due to shear force of the pair of engaging convex portions 13 and 14 installed on the FPC 1.

In the connector 20, with the pair of metal reinforcing plates 2*a* and 2*b* that have the convex portions 210 that are latched by the pair of protrusions 21*a* and 21*b* and also the pair of engaging convex portions 13 and 14, adjoining two flanks of the pair of protrusions 21*a* and 21*b*, breakage of the pair of protrusions 21*a* and 21*b* is prevented.

That is, if a force tending to cause disconnection from the connector 20 is applied to the FPC 1, the pair of engaging convex portions 13 and 14 makes contact with the convex portions 210 formed on the pair of metal reinforcing plates 2*a* and 2*b*, which are strengthened, and breakage of the pair of protrusions 21*a* and 21*b* does not occur.

As described above, the pair of engaging convex portions 13 and 14 of the FPC 1 is latched by the pair of protrusions 21*a* and 21*b* provided on the concave portion 21 of the connector and the convex portion 210 provided on the pair of metal reinforcing plates 2*a* and 2*b*, and it is possible to prevent the FPC 1 from disconnecting from the connector 20. This pair of protrusions 21*a* and 21*b* is formed in the shape of quadrangular prisms, generally being formed at fabrication of the housing.

On the other hand, the terminal 10 including the pair of engaging convex portions 13 and 14 can be obtained by punching. In order to avoid concentration of stress at the corners where the two side edges 15*a* and 16*a* of the FPC 1 are orthogonal to the pair of stopper side edges 13*a* and 14*a* (see FIG. 2), the corners are generally formed in a circular curved shape, that is, with a radius "r".

However, since the protrusion height of the engaging convex portion 13 from one side edge 15*a* of the FPC 1 is very small, being, for example, about 0.3 mm, and since the corner of the foot of the protrusion installed on the connector (a circular-curve shaped fillet) opposes the "r" curve of the corner of the engaging convex portion provided on the FPC 1, there is a concern that the latching of the FPC 1 by the connector may be unreliable.

Accordingly, a pair of notches 15 and 16, formed by narrowing the width between the side edges of the FPC 1, is provided, in a region extending, in a direction opposite to that in which the FPC 1 is inserted, from corners where the pair of stopper side edges 13*a* and 14*a* are orthogonal to the two side edges 15*a* and 16*a* of the FPC 1, to give a structure in which the corner of the foot of the protrusion (a circular-curve shaped fillet) is not in contact, and latching of the FPC by the connector is assured. Furthermore, the circular curve shape is formed in order to avoid stress concentrations in the corner areas of the notches 15 and 16 (see FIG. 2).

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A flexible printed circuit connector comprising:

a housing in which is formed a concave portion into which a flexible printed circuit with a pair of engaging convex portions arranged on two flanks of a terminal portion of the flexible printed circuit, is inserted;

a cover-housing for covering, with opening and closing enabled, the concave portion of the housing, the housing having a pair of protrusions that protrudes from a bottom face of the concave portion and are latched by the pair of engaging convex portions; and a pair of metal reinforcing plates, adjoining two flanks of the pair of protrusions, the metal reinforcing plates having convex portions that are latched by the protrusions and the engaging convex portions.

2. The FPC connector according to claim 1, wherein the pair of metal reinforcing plates is pressed into the housing, and rotatably supports an opening-closing axis formed at both ends of the cover-housing, bottom faces of the pair of metal-reinforcing plates being joined to a printed circuit board.

* * * * *